US007533729B2

(12) United States Patent
Rogers et al.

(10) Patent No.: US 7,533,729 B2
(45) Date of Patent: May 19, 2009

(54) REVERSE CEMENTING FLOAT EQUIPMENT

(75) Inventors: Henry E. Rogers, Duncan, OK (US); Steven L. Holden, Fletcher, OK (US); David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 254 days.

(21) Appl. No.: 11/264,228

(22) Filed: Nov. 1, 2005

(65) Prior Publication Data

US 2007/0095533 A1 May 3, 2007

(51) Int. Cl.
*E21B 34/06* (2006.01)

(52) U.S. Cl. ..... 166/332.8; 166/177.4; 137/614.21

(58) Field of Classification Search ..... 166/285, 166/177.4, 332.8; 137/614.03, 614.19, 614.21
See application file for complete search history.

(56) References Cited

U.S. PATENT DOCUMENTS

| | | | | |
|---|---|---|---|---|
| 2,223,509 | A | 12/1940 | Brauer | 166/4 |
| 2,230,589 | A | 2/1941 | Driscoll | 285/22 |
| 2,407,010 | A | 9/1946 | Hudson | 103/5 |
| 2,472,466 | A | 6/1949 | Counts et al. | 285/22 |
| 2,492,271 | A * | 12/1949 | Cox et al. | 137/614.03 |
| 2,647,727 | A | 8/1953 | Edwards | 255/28 |
| 2,675,082 | A | 4/1954 | Hall | 166/22 |
| 2,849,213 | A | 8/1958 | Failing | 255/24 |
| 2,919,709 | A | 1/1960 | Schwegman | 137/68 |
| 3,051,246 | A | 8/1962 | Clark, Jr. et al. | 166/226 |
| 3,053,278 | A * | 9/1962 | Verheul | 137/614.21 |
| 3,193,010 | A | 7/1965 | Bielstien | 166/21 |
| 3,277,962 | A | 10/1966 | Flickinger et al. | 166/15 |
| 3,537,477 | A * | 11/1970 | Mahoff | 137/614.03 |
| 3,570,596 | A | 3/1971 | Young | 166/129 |
| 3,850,250 | A | 11/1974 | Holden et al. | |
| 3,858,649 | A | 1/1975 | Wray et al. | |
| 3,930,540 | A | 1/1976 | Holden et al. | |
| 3,948,322 | A | 4/1976 | Baker | 166/289 |

(Continued)

FOREIGN PATENT DOCUMENTS

EP 0 419 281 A2 3/1991

(Continued)

OTHER PUBLICATIONS

Griffith, et al., "Reverse Circulation of Cement on Primary Jobs Increases Cement Column Height Across Weak Formations," Society of Petroleum Engineers, SPE 25440, 315-319, Mar. 22-23, 1993.

(Continued)

*Primary Examiner*—Kenneth Thompson
(74) *Attorney, Agent, or Firm*—John W. Wustenberg; Baker Botts, L.L.P.

(57) ABSTRACT

A regulating valve assembly for regulating fluid flow through a passage, the assembly having: a back-flow valve comprising a seat and a closure element, wherein the closure element engages with the seat in a closed configuration and disengages from the seat in an open configuration; a lock in mechanical communication with the back-flow valve to lock the backflow valve in the open configuration; and a forward-flow valve in mechanical communication with the lock and comprising a seat and a closure element, wherein the closure element engages with the seat in a closed configuration and disengages from the seat in an open configuration.

14 Claims, 9 Drawing Sheets

U.S. PATENT DOCUMENTS

| | | | | |
|---|---|---|---|---|
| 3,948,588 | A | 4/1976 | Curington et al. | 417/405 |
| 3,951,208 | A | 4/1976 | Delano | 166/78 |
| 3,957,114 | A * | 5/1976 | Streich | 166/285 |
| 3,964,305 | A | 6/1976 | Wray et al. | |
| 4,058,165 | A | 11/1977 | Holden et al. | |
| 4,105,069 | A | 8/1978 | Baker | 166/51 |
| 4,270,608 | A | 6/1981 | Hendrickson et al. | |
| 4,271,916 | A | 6/1981 | Williams | 175/215 |
| 4,273,190 | A | 6/1981 | Baker et al. | |
| 4,295,524 | A | 10/1981 | Baker et al. | |
| 4,300,633 | A | 11/1981 | Stewart | 166/250 |
| 4,304,298 | A | 12/1981 | Sutton | 166/293 |
| 4,340,427 | A | 7/1982 | Sutton | 106/87 |
| 4,367,093 | A | 1/1983 | Burkhalter et al. | 106/87 |
| 4,369,840 | A | 1/1983 | Szarka et al. | |
| RE31,190 | E | 3/1983 | Detroit et al. | 166/293 |
| 4,450,010 | A | 5/1984 | Burkhalter et al. | 106/87 |
| 4,457,379 | A | 7/1984 | McStravick | |
| 4,469,174 | A | 9/1984 | Freeman | 166/202 |
| 4,519,452 | A | 5/1985 | Tsao et al. | 166/288 |
| 4,531,583 | A | 7/1985 | Revett | 166/253 |
| 4,548,271 | A | 10/1985 | Keller | 166/291 |
| 4,555,269 | A | 11/1985 | Rao et al. | 106/90 |
| 4,565,578 | A | 1/1986 | Sutton et al. | 106/87 |
| 4,606,408 | A | 8/1986 | Zunkel et al. | |
| 4,627,488 | A | 12/1986 | Szarka et al. | |
| 4,671,356 | A | 6/1987 | Barker et al. | 166/285 |
| 4,676,832 | A | 6/1987 | Childs et al. | 106/90 |
| 4,718,495 | A | 1/1988 | Lubitz et al. | |
| 4,729,432 | A | 3/1988 | Helms | |
| 4,791,988 | A | 12/1988 | Trevillion | 166/285 |
| 4,949,788 | A | 8/1990 | Szarka et al. | |
| 4,961,465 | A | 10/1990 | Brandell | 166/184 |
| 4,979,561 | A | 12/1990 | Szarka et al. | |
| 4,991,654 | A | 2/1991 | Brandell et al. | |
| 5,024,273 | A | 6/1991 | Coone et al. | 166/289 |
| 5,029,644 | A | 7/1991 | Szarka et al. | |
| 5,117,910 | A | 6/1992 | Brandell et al. | 166/291 |
| 5,125,455 | A | 6/1992 | Harris et al. | 166/292 |
| 5,133,409 | A | 7/1992 | Bour et al. | 166/293 |
| 5,147,565 | A | 9/1992 | Bour et al. | 252/8.551 |
| 5,188,176 | A | 2/1993 | Carpenter | 166/285 |
| 5,213,161 | A | 5/1993 | King et al. | 166/293 |
| 5,273,112 | A | 12/1993 | Schultz | 166/374 |
| 5,297,634 | A | 3/1994 | Loughlin | 166/387 |
| 5,318,118 | A | 6/1994 | Duell | 166/202 |
| 5,323,858 | A | 6/1994 | Jones et al. | 166/291 |
| 5,325,917 | A | 7/1994 | Szarka et al. | |
| 5,361,842 | A | 11/1994 | Hale et al. | 166/293 |
| 5,375,661 | A | 12/1994 | Daneshy et al. | |
| 5,484,019 | A | 1/1996 | Griffith | 166/293 |
| 5,494,107 | A | 2/1996 | Bode | 166/285 |
| 5,507,345 | A | 4/1996 | Wehunt, Jr. et al. | 166/285 |
| 5,559,086 | A | 9/1996 | Dewprashad et al. | 507/219 |
| 5,571,281 | A | 11/1996 | Allen | 366/2 |
| 5,577,865 | A | 11/1996 | Manrique et al. | 405/266 |
| 5,641,021 | A | 6/1997 | Murray et al. | 166/291 |
| 5,647,434 | A | 7/1997 | Sullaway et al. | 166/242.8 |
| 5,671,809 | A | 9/1997 | McKinzie | 166/285 |
| 5,718,292 | A | 2/1998 | Heathman et al. | 166/387 |
| 5,738,171 | A | 4/1998 | Szarka | 166/289 |
| 5,749,418 | A | 5/1998 | Mehta et al. | 166/292 |
| 5,762,139 | A | 6/1998 | Sullaway et al. | 166/291 |
| 5,787,979 | A * | 8/1998 | Giroux et al. | 166/177.4 |
| 5,803,168 | A | 9/1998 | Lormand et al. | 166/77.2 |
| 5,829,526 | A | 11/1998 | Rogers et al. | 166/291 |
| 5,875,844 | A | 3/1999 | Chatterji et al. | 166/293 |
| 5,890,538 | A | 4/1999 | Beirute et al. | 166/285 |
| 5,897,699 | A | 4/1999 | Chatterji et al. | 106/678 |
| 5,900,053 | A | 5/1999 | Brothers et al. | 106/678 |
| 5,913,364 | A | 6/1999 | Sweatman | 166/281 |
| 5,968,255 | A | 10/1999 | Mehta et al. | 106/724 |
| 5,972,103 | A | 10/1999 | Mehta et al. | 106/728 |
| 6,060,434 | A | 5/2000 | Sweatman et al. | 507/216 |
| 6,063,738 | A | 5/2000 | Chatterji et al. | 507/269 |
| 6,098,710 | A | 8/2000 | Rhein-Knudsen et al. | 166/285 |
| 6,138,759 | A | 10/2000 | Chatterji et al. | 166/293 |
| 6,143,069 | A | 11/2000 | Brothers et al. | 106/678 |
| 6,167,967 | B1 | 1/2001 | Sweatman | 166/281 |
| 6,196,311 | B1 | 3/2001 | Treece et al. | 166/192 |
| 6,204,214 | B1 | 3/2001 | Singh et al. | 501/155 |
| 6,244,342 | B1 | 6/2001 | Sullaway et al. | 166/285 |
| 6,258,757 | B1 | 7/2001 | Sweatman et al. | 507/219 |
| 6,311,775 | B1 | 11/2001 | Allamon et al. | 166/285 |
| 6,318,472 | B1 | 11/2001 | Rogers et al. | 166/382 |
| 6,367,550 | B1 | 4/2002 | Chatterji et al. | 166/293 |
| 6,431,282 | B1 | 8/2002 | Bosma et al. | 166/288 |
| 6,454,001 | B1 | 9/2002 | Thompson et al. | 166/250.14 |
| 6,457,524 | B1 | 10/2002 | Roddy | 166/293 |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,488,088 | B1 | 12/2002 | Kohli et al. | 166/285 |
| 6,488,089 | B1 | 12/2002 | Bour et al. | 166/292 |
| 6,488,763 | B2 | 12/2002 | Brothers et al. | 106/692 |
| 6,540,022 | B2 | 4/2003 | Dusterhoft et al. | 166/278 |
| 6,547,007 | B2 | 4/2003 | Szarka et al. | |
| 6,571,876 | B2 | 6/2003 | Szarka et al. | |
| 6,622,798 | B1 | 9/2003 | Rogers et al. | 166/380 |
| 6,651,743 | B2 | 11/2003 | Szarka | |
| 6,666,266 | B2 | 12/2003 | Starr et al. | 166/90.1 |
| 6,679,336 | B2 | 1/2004 | Musselwhite et al. | 166/386 |
| 6,715,553 | B2 | 4/2004 | Reddy et al. | 166/309 |
| 6,722,434 | B2 | 4/2004 | Reddy et al. | 166/292 |
| 6,725,935 | B2 | 4/2004 | Szarka et al. | 166/318 |
| 6,732,797 | B1 | 5/2004 | Watters et al. | 166/291 |
| 6,758,281 | B2 | 7/2004 | Sullaway et al. | 166/386 |
| 6,802,374 | B2 | 10/2004 | Edgar et al. | 166/285 |
| 6,808,024 | B2 | 10/2004 | Schwendemann et al. | 166/387 |
| 6,810,958 | B2 | 11/2004 | Szarka et al. | 166/285 |
| 6,820,695 | B2 | 11/2004 | Stevens et al. | |
| 7,182,135 | B2 | 2/2007 | Szarka | |
| 7,225,871 | B2 | 6/2007 | Rogers et al. | |
| 7,287,584 | B2 * | 10/2007 | Angman et al. | 166/177.4 |
| 2002/0148614 | A1 | 10/2002 | Szarka | |
| 2003/0000704 | A1 | 1/2003 | Reynolds | 166/312 |
| 2003/0029611 | A1 | 2/2003 | Owens | 166/250.03 |
| 2003/0072208 | A1 | 4/2003 | Rondeau et al. | 366/16 |
| 2003/0173091 | A1 * | 9/2003 | Horne et al. | 166/386 |
| 2003/0192695 | A1 | 10/2003 | Dillenbeck et al. | 166/285 |
| 2004/0079553 | A1 | 4/2004 | Livingstone | 175/61 |
| 2004/0084182 | A1 | 5/2004 | Edgar et al. | 166/285 |
| 2004/0099413 | A1 | 5/2004 | Arceneaux | 166/173 |
| 2004/0104050 | A1 | 6/2004 | Järveläet al. | 175/57 |
| 2004/0104052 | A1 | 6/2004 | Livingstone | 175/61 |
| 2004/0177962 | A1 | 9/2004 | Bour | 166/285 |
| 2004/0231846 | A1 | 11/2004 | Griffith et al. | 166/291 |
| 2005/0061546 | A1 | 3/2005 | Hannegan | 175/7 |
| 2006/0016599 | A1 | 1/2006 | Badalamenti et al. | 166/285 |
| 2006/0016600 | A1 | 1/2006 | Badalamenti et al. | 166/285 |
| 2006/0042798 | A1 | 3/2006 | Badalamenti et al. | 166/285 |
| 2006/0086499 | A1 | 4/2006 | Badalamenti et al. | 166/250.14 |
| 2006/0086502 | A1 | 4/2006 | Reddy et al. | 166/291 |
| 2006/0086503 | A1 | 4/2006 | Reddy et al. | 166/293 |
| 2006/0131018 | A1 | 6/2006 | Rogers et al. | 166/285 |
| 2007/0062700 | A1 | 3/2007 | Webb et al. | |
| 2007/0095533 | A1 | 5/2007 | Rogers et al. | |
| 2007/0102158 | A1 | 5/2007 | Szarka | |
| 2007/0102159 | A1 | 5/2007 | Szarka | |
| 2007/0137870 | A1 | 6/2007 | Griffith et al. | |
| 2008/0011481 | A1 | 1/2008 | Badalamenti et al. | |

2008/0011482 A1 1/2008 Badalamenti et al.

FOREIGN PATENT DOCUMENTS

| | | | |
|---|---|---|---|
| GB | 2193741 | | 2/1988 |
| GB | 2327442 | A | 11/1999 |
| GB | 2348828 | A | 10/2000 |
| RU | 1774986 | | 11/1992 |
| RU | 1778274 | | 11/1992 |
| RU | 1542143 | C | 12/1994 |
| RU | 2067158 | | 9/1996 |
| RU | 2 086 752 | C1 | 8/1997 |
| SU | 571581 | | 9/1977 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | A1 | 8/1992 |
| WO | WO 2004/104366 | | 12/2004 |
| WO | WO 2005/083299 | A | 9/2005 |
| WO | WO 2006/008490 | A1 | 1/2006 |
| WO | WO 2006/064184 | A1 | 6/2006 |

OTHER PUBLICATIONS

Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Fryer, "Evaluation of the Effects of Multiples in Seismic Data From the Gulf Using Vertical Seismic Profiles," SPE 25540, 1993.
Carpenter, et al., "Remediating Sustained Casing Pressure by Forming a Downhole Annular Seal with Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier" 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the StrataLock Stabilization System", 1998.
R. Marquaire et al., "Primary Cementing By Reverse Circulation Solves Critical Problem in the North Hassi-Messaoud Field, Algeria", SPE 1111., Feb. 1996.
Halliburton Brochure Entitled "Perlite Cement Additive", 1999.
Halliburton Brochure Entitled "The Permseal System Versatile, Cost-Effective Sealants for Conformance Applications", 2002.
Halliburton Brochure Entitled "POZMIX® A Cement Additive", 1999.
Foreign Communication from a Related Counter Part Application, Dec. 9, 2005.
Foreign Communication From A Related Counter Part Application, Feb. 24, 2005.
Foreign Communication From A Related Counter Part Application, Dec. 27, 2005.
Foreign Communication From A Related Counter Part Application, Feb. 23, 2006.
Foreign Communication From A Related Counter Part Application, Feb. 27, 2007.
Foreign Communication From A Related Counter Part Application, Jan. 8, 2007.
Foreign Communication From A Related Counter Part Application, Jan. 17, 2007.
Foreign communication related to a counterpart application dated Jan. 22, 2007.

* cited by examiner

REVERSE CEMENTING FLOAT EQUIPMENT

BACKGROUND

This invention relates to reverse cementing operations. In particular, this invention relates to methods and apparatuses for floating the casing and controlling fluid flow through the casing shoe.

After a well for the production of oil and/or gas has been drilled, casing may be run into the wellbore and cemented. In conventional cementing operations, a cement composition is displaced down the inner diameter of the casing. The cement composition is displaced downward into the casing until it exits the bottom of the casing into the annular space between the outer diameter of the casing and the wellbore apparatus. It is then pumped up the annulus until a desired portion of the annulus if filled.

The casing may also be cemented into a wellbore by utilizing what is known as a reverse-cementing method. The reverse-cementing method comprises displacing a cement composition into the annulus at the surface. As the cement composition is pumped down the annulus, well fluids ahead of the cement composition are displaced down and around the lower end of the casing string and up the inner diameter of the casing string and out to surface. The fluids ahead of the cement composition may also be displaced upwardly through a work string that has been run into the inner diameter of the casing string and sealed off at its lower end. Because the work string by definition has a smaller inner diameter, fluid velocities in a work string configuration may be higher and may more efficiently transport the cuttings washed out of the annulus during cementing operations.

The reverse circulation cementing process, as opposed to the conventional method, may provide a number of advantages. For example, cementing pressures may be much lower than those experienced with conventional methods. Cement composition introduced in the annulus falls down the annulus so as to produce little or no pressure on the formation. Fluids in the wellbore ahead of the cement composition may be bled off through the casing at surface. When the reverse-circulating method is used, less fluid may be handled at surface and cement retarders may be utilized more efficiently or eliminated altogether.

In many applications, float devices are used as the casing is run into the wellbore. Float shoes and float collars typically contain a back pressure check valve to prevent the flow of fluid into the bottom of the casing string as the casing is run into the wellbore or once the casing has reached its target depth. Float apparatuses may be used to prevent back flow of cement composition into the casing inner diameter after the cementing operations have been completed. Float apparatuses may also prevent oil and/or gas under high pressure from entering the inner diameter of the casing as the casing string is being run into the wellbore. If gas or oil under high pressure does enter the wellbore, it can result in a well blowout. Additionally, the weight of the casing, particularly with deep wells, often creates a tremendous amount of stress and strain on the derrick surface equipment and on the casing. Float apparatuses may minimize that stress as the casing is lowered into the wellbore because they make the casing string more buoyant in the wellbore.

SUMMARY

This invention relates to reverse cementing operations. In particular, this invention relates to methods and apparatuses for floating the casing and controlling fluid flow through the casing shoe.

According to one aspect of the invention, there is provided a regulating valve assembly for regulating fluid flow through a passage, the assembly having: a back-flow valve comprising a seat and a closure element, wherein the closure element engages with the seat in a closed configuration and disengages from the seat in an open configuration; a lock in mechanical communication with the back-flow valve to lock the back-flow valve in the open configuration; and a forward-flow valve in mechanical communication with the lock and comprising a seat and a closure element, wherein the closure element engages with the seat in a closed configuration and disengages from the seat in an open configuration.

A further aspect of the invention provides a regulating valve assembly for regulating fluid flow through a passage, the assembly having: a back-flow valve comprising a seat and a closure element, wherein the closure element engages with the seat in a closed configuration and disengages from the seat in an open configuration; a sleeve, wherein the sleeve stings into the seat of the back-flow valve when the back-flow valve is in the open configuration and unstings from the seat of the back-flow valve when the back-flow valve is in the closed configuration; and a forward-flow valve positioned with the sleeve and comprising a seat and a closure element, wherein the closure element engages with the seat in a closed configuration and disengages from the seat in an open configuration.

According to still another aspect of the invention, there is provided a method for reverse-cementing casing in a wellbore, the method having steps as follows: locking a back-flow valve in an open configuration and making the back-flow valve up to the casing; running the casing equipped with the back-flow valve into the wellbore to a target depth; reverse-circulating a cement composition into an annulus defined in the wellbore by the casing; taking fluid returns through the back-flow valve as the cement composition is reverse-circulated into the annulus; unlocking the back-flow valve; and closing the back-flow valve, whereby the cement composition is retained in the annulus by the back-flow valve.

The objects, features, and advantages of the present invention will be readily apparent to those skilled in the art upon a reading of the description of the exemplary embodiments which follows.

BRIEF DESCRIPTION OF THE FIGURES

The present invention may be better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION

This invention relates to reverse cementing operations. In particular, this invention relates to methods and apparatuses for floating the casing and controlling fluid flow through the casing shoe.

Figure 1A:
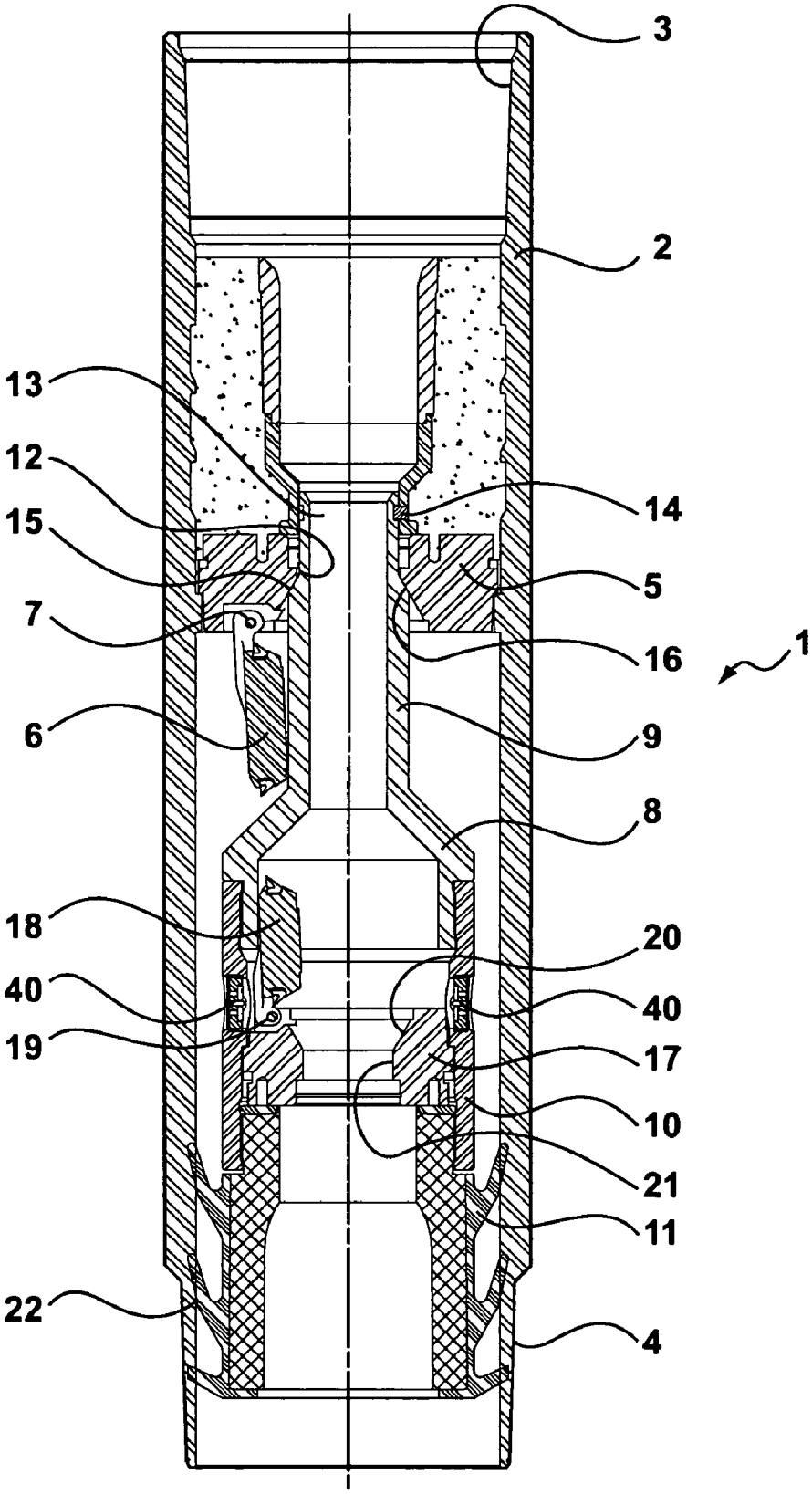
FIG. 1A is a cross-sectional, side view of a reverse cementing float apparatus having back-flow and forward-flow flappers, wherein both flappers are open.

Referring to FIG. 1A, a cross sectional side view of a dual flapper apparatus of the present invention is illustrated. This figure shows the float apparatus in the run-in-hole position. An upper flapper is retained in the open position by a pinned stinger sleeve that is attached to a lower assembly which contains a lower flapper valve. With this assembly installed in the casing, reverse circulation may be performed through the lower flapper as shown. The lower flapper also allows the casing to self-fill as it is run-in-hole. Not shown in this figure is a fill-up assembly that holds the lower flapper open to allow conventional circulation through the apparatus.

The float apparatus 1 has a pipe section 2 having a female box end 3 for mating with an upper casing string (not shown). The pipe section 2 also has a male pin end 4 at its lower end for mating with a casing shoe or other tool (not shown). A back-flow flapper seat 5 is positioned within the pipe section 2 and is mechanically shouldered inside pipe section 2 on the bottom side of the seat 5 to prevent downward movement of the seat 5 with the application of forces exerted in that direction. Cement or other drillable material fills an annular space above the seat 5 to further secure the seat 5 in the casing 2. A back-flow flapper 6 pivotally connected to the back-flow flapper seat 5. At the hinge point 7 between the back-flow flapper 6 and the back-flow flapper seat 5, a spring is employed to bias the back-flow flapper 6 to a closed position (FIG. 1 A illustrates the back-flow flapper 6 in an open position). A stinger sleeve 8 is positioned within the pipe section 2 and is stung into the back-flow flapper seat 5. The stinger sleeve 8 has a stinger section 9, a valve section 10, and a seal section 11.

The stinger section 9 is a tubular structure having an outside diameter at its upper end that is slightly smaller than the inside diameter of a hole 12 through the back-flow flapper seat 5. At its distal end, the stinger section 9 has a notch 13 for receiving a shear pin (or pins) 14 that extends from the back-flow flapper seat 5. A beveled shoulder 15 extends radially from the stinger section 9 and rests on a conical rim 16 of the back-flow flapper seat 5, when the stinger section 9 is stung into the back-flow flapper seat 5. Thus, the upper (back) end of the stinger sleeve 8 is shouldered off solidly in the back flow flapper seat 5 so as to prevent backward movement of the stinger sleeve 8.

The valve section 10 of the stinger sleeve 8 has a forward-flow flapper seat 17 and a forward-flow flapper 18. The forward-flow flapper 18 is connected to the forward-flow flapper seat 17 at hinge point 19. The forward-flow flapper seat 17 has a conical rim 20 for receiving the forward-flow flapper 18 when the flapper is in a closed configuration. The forward-flow flapper seat 17 also has a hole 21 through its center for transmitting fluids through the flapper seat when the flapper is in an open configuration. A series of one-way pressure equalizer valves 40 are positioned in the side walls of the valve section 10 between the stinger section 9 and the forward flow flapper seat 17.

The seal section 11 of the stinger sleeve 8 is positioned below (forward) the valve section 10. The seal section 11 has a cylindrical structure with a bore for passing fluids through its center. It also has three annular seal ribs 22 which extend outwardly to engage the interior surface of the pipe section 2. In alternative embodiments of the invention, any number of annular seal ribs may be used. Because the seal ribs 22 extend in an upward (backward) direction relative to the interior surface of the pipe section 2, the seal section 11 permits the stinger sleeve 8 to be moved in a downward (forward) direction.

The float apparatus 1 is run into the wellbore in the configuration illustrated in FIG. 1A. In particular, the stinger sleeve 8 is stung into the back-flow flapper seat 5 so that the back-flow flapper 6 is locked in an open configuration. Further, while the forward-flow flapper 18 is biased to a closed position by a spring at the hinge point 19, the forward-flow flapper 18 remains in an unlocked configuration so that fluid may freely flow back through the flow apparatus 1 as it is run into the wellbore. Back flow through the forward flow flapper seat 17 is intermittent as the casing and float apparatus 1 are lowered into the wellbore one casing joint at a time. The forward flow flapper 18 opens as positive differential pressure acting from the bottom (forward) side of the flapper becomes sufficient to overcome the spring bias at hinge point 19, with the forward flow flapper 18 re-closing as the differential pressure becomes insufficient to keep the flapper open (as casing movement is stopped to connect the next joint). As the float apparatus 1 is run into the wellbore, the equalizer valves 40 relieve an annular dead air space otherwise trapped around the outside of the stinger sleeve 8 between the seal section 11 and the back flow flapper seat 5. The equalizer valves 40 allow trapped air and or fluids to evacuate into the inner diameter of the stinger sleeve 8 and thus to surface as the casing is being run into the wellbore.

Figure 1B:
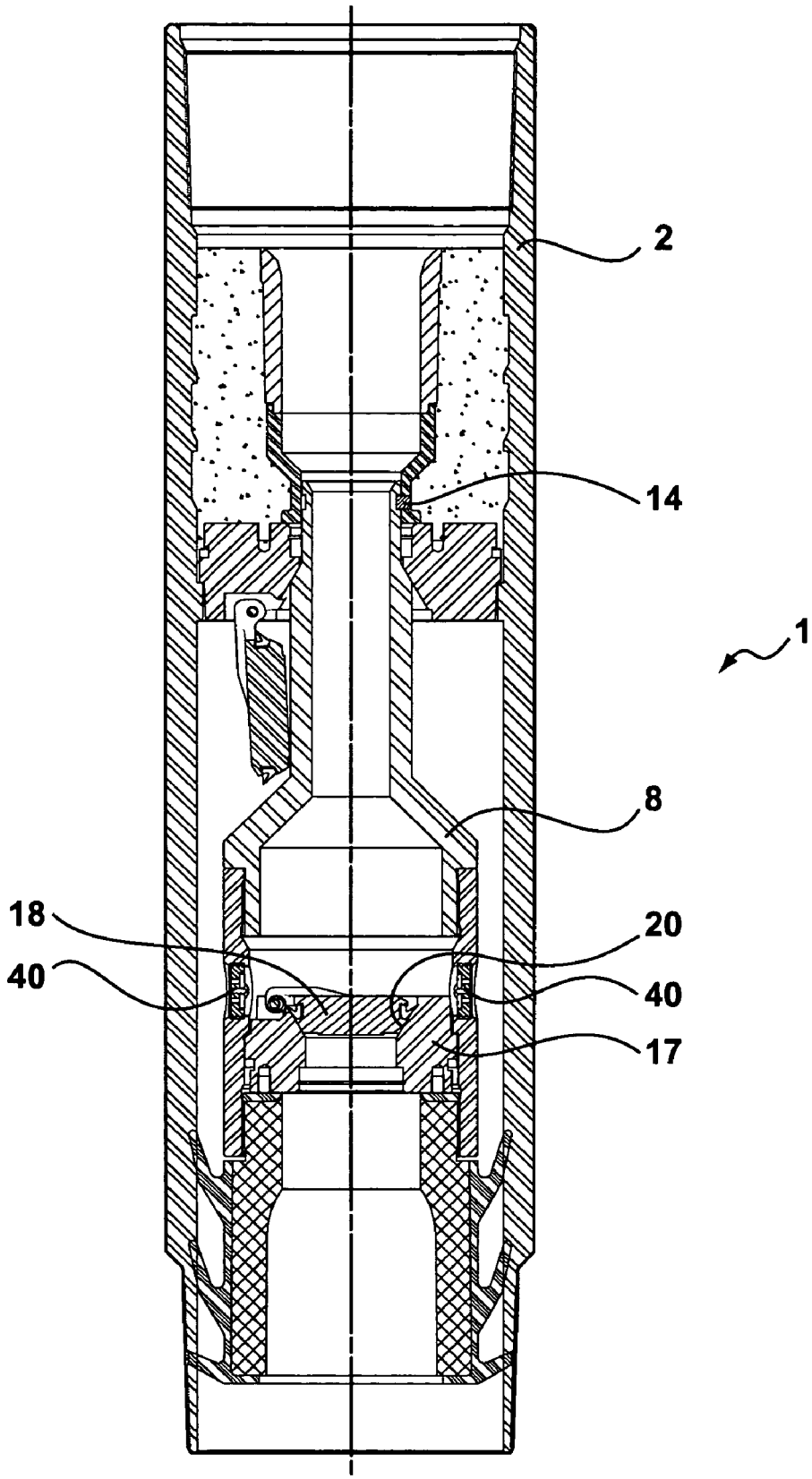
FIG. 1B is a cross-sectional, side view of the reverse cementing float apparatus of FIG. 1A, wherein the forward-flow flapper is closed.

FIG. 1B is a cross-sectional side view of the float apparatus 1 shown in FIG. 1A. This figure shows the apparatus at target depth and after slurry has entered the casing inner diameter either confirmed by calculation or by returns through the work string at the surface. Once adequate slurry has been pumped, fluid flow is reversed and pumped down the casing inner diameter. This process closes the forward-flow flapper 18 and applies a hydraulic load to the shear pins 14 which hold the stinger sleeve 8 in place. When downward flow is initiated down the casing string to pump the stinger sleeve 8 out of the back flow flapper seat 5, the equalizer valves 40 seal to permit application of fluid pressure against the closed forward flow flapper 18, as described more fully below.

With the bottom of the casing (not shown) at the target depth, a reverse circulation cementing operation may be conducted in the wellbore. Circulation fluid is reverse circulated down the annulus between the casing and the wellbore and up through the stinger sleeve 8 and pipe section 2 of the float apparatus 1. Because the forward-flow flapper 18 is merely biased toward a closed configuration, it opens freely as the circulation fluid is pumped up through the stinger sleeve 8. A cement composition slurry is pumped down the annulus behind the circulation fluid to fill the annulus between the casing and the wellbore. When the cement composition slurry reaches the bottom of the wellbore and enters the inner diameter of the casing, either confirmed by calculation or by returns at the surface, the reverse circulation flow is stopped. Fluid flow in the wellbore is then reversed and pumped down the inner diameter of the casing to apply a hydraulic load to the interior of the pipe section 2 and stinger sleeve 8. With the forward-flow flapper 18 bias toward a closed position, the forward-flow flapper 18 readily positions itself in the conical rim 20 of the forward-flow flapper seat 17 to completely seal the interior of the stinger sleeve 8 against the hydraulic load. The hydraulic pressure within the stinger sleeve 8 is increased until a downward force applied to the stinger sleeve 8 is sufficient to overcome the shear strength of the shear pins 14.

Figure 1C:
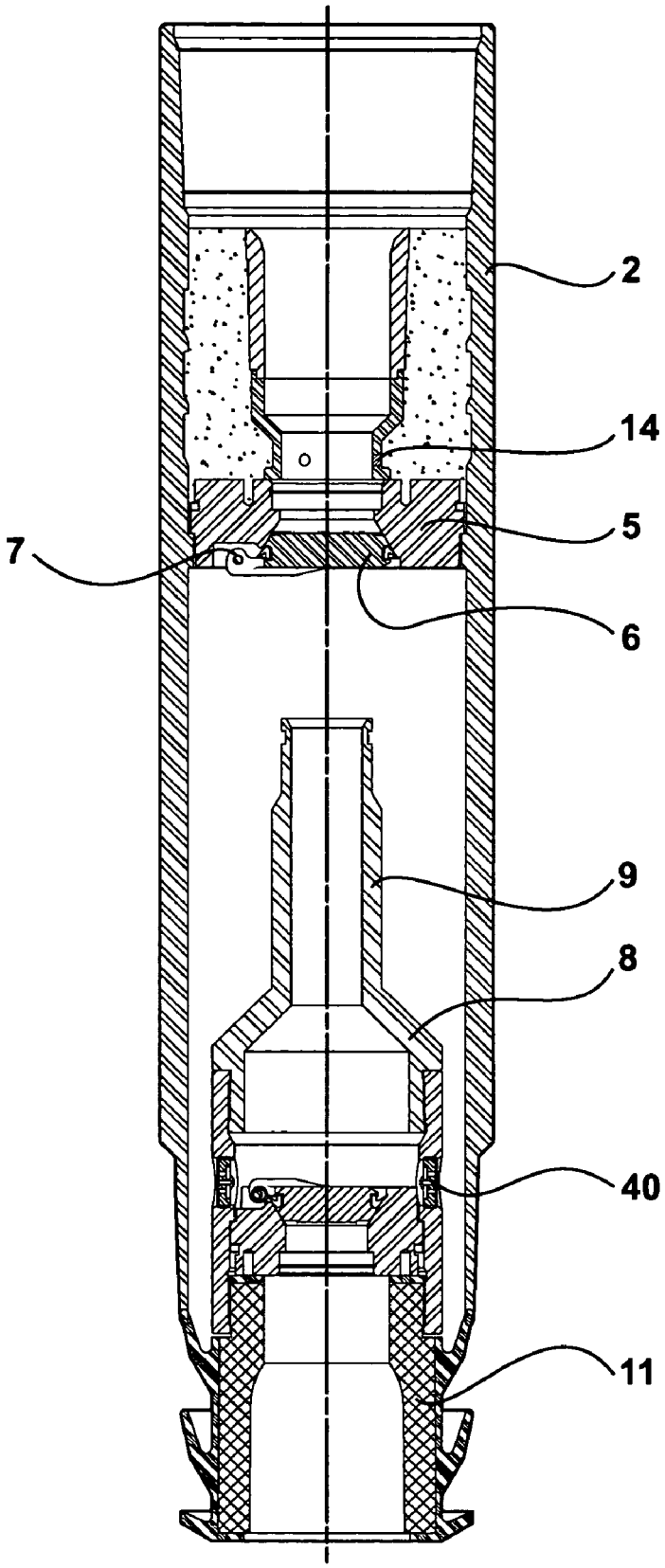
FIG. 1C is a cross-sectional, side view of the reverse cementing float apparatus of FIGS. 1A and 1B, wherein the back-flow flapper is closed.

FIG. 1C illustrates a cross-sectional side view of the float apparatus shown in FIG. 1A and 1B. This figure shows the back-flow flapper 6 in the closed position after the stinger sleeve 8 has sheared loose from the upper flapper. This design allows for both over balanced and under balanced cementing operations to be performed in the reverse direction. In certain embodiments of the invention, the flow area through the forward flow flapper seat 17 and/or through the minimum bore of the stinger section 9 (whichever has the lesser flow area) may be less than the flow area of the annulus defined by the wellbore and the casing. Those embodiments may create a pressure drop or choke to assist in keeping the hydrostatic overbalance in the annulus (generally the cement will be heavier than the well fluid it is displacing) from completely running away with itself as the fluid flows in the reverse direction.

In FIG. 1C the shear pins 14 have released the stinger section 9 of the stinger sleeve 8. Further, the hydraulic load applied to the inside of the pipe section 2 and the stinger sleeve 8 has pumped the stinger sleeve 8 downwardly relative to the pipe section 2. Once the stinger section 9 has cleared the back-flow flapper seat 5, the seal section 11 of the stinger sleeve 8 shares the hydraulic load with the forward-flow flapper 18 so that the stinger sleeve 8 is pumped even further downwardly (forwardly) relative to the pipe section 2. If desired, the stinger sleeve 8 may be pumped completely out of the bottom of the pipe section 2 and allowed to free fall to the bottom of the rat hole in the wellbore. The stinger sleeve 8 may be displaced to a guide shoe or other landing seat at what would be the lower end of the shoe track. After the stinger section 9 clears the back-flow flapper seat 5, the back-flow flapper 6 pivots about the hinge point 7 to a closed configuration. When displacement stops, the back-flow flapper 6 closes and retains the differential pressure from the weighted slurry in the annulus. With the back-flow flapper 6 closed, the hydrostatic load on the inner diameter of the casing and pipe section 2 may be released. The closed back-flow flapper 6 prevents the cement composition slurry in the annulus from U-tubing back up through the float apparatus 1 into the inner diameter of the casing.

Figure 2A:
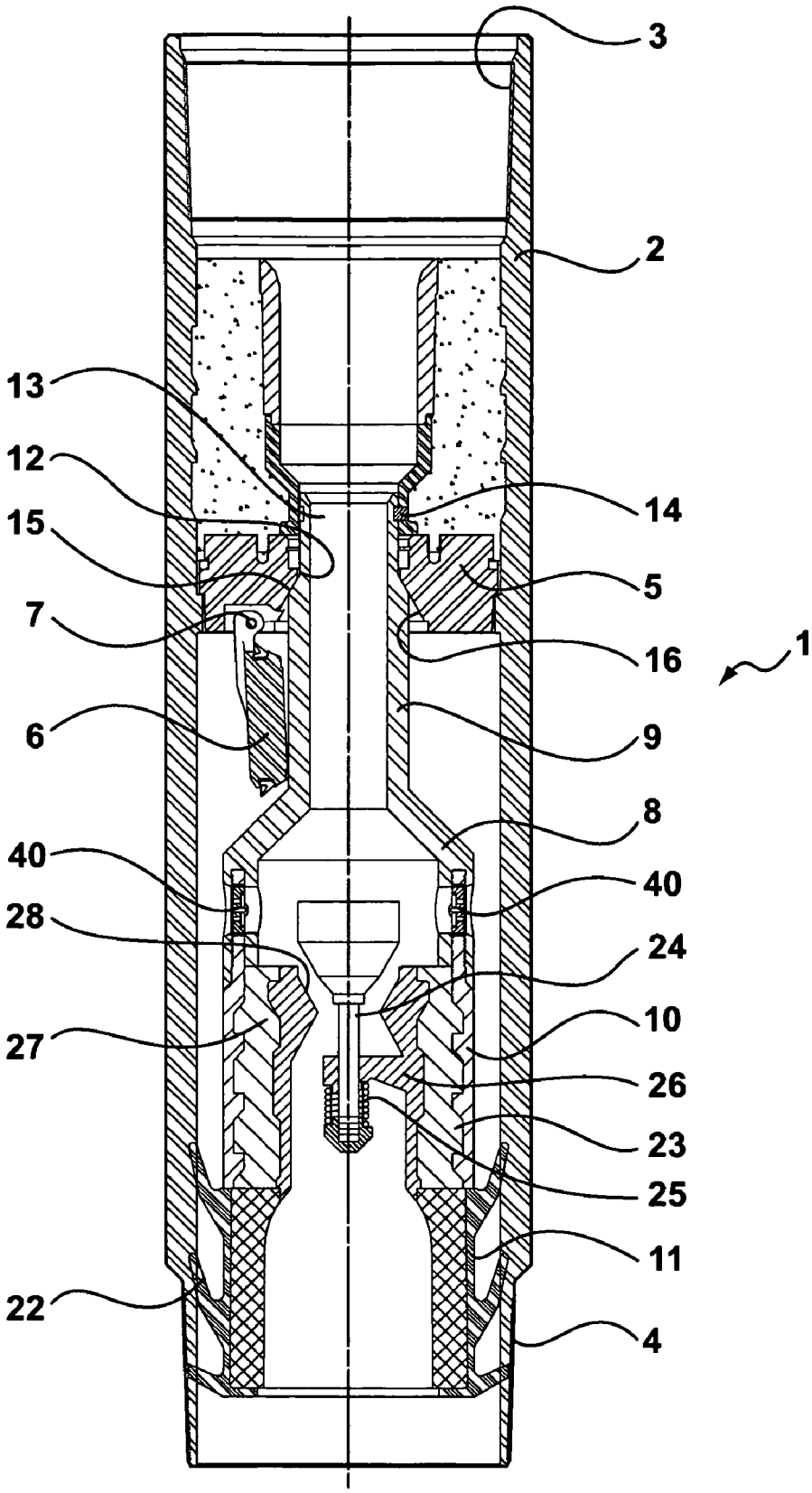
FIG. 2A is a cross-sectional, side view of a reverse cementing float apparatus having a back-flow flapper and a poppet valve, wherein both the back-flow flapper and poppet valve are open.

Referring to FIG. 2A, a cross-sectional side view of a float apparatus of the present invention is illustrated. The float apparatus 1 has a pipe section 2 having a female box end 3 for mating with an upper casing string (not shown). The pipe section 2 also has a male pin end 4 at its lower end for mating with a lower casing shoe or other tool (not shown). The float apparatus 1 has a back-flow flapper seat 5 that is mechanically shouldered inside pipe section 2 on the bottom side of the seat 5 to prevent downward movement of the seat 5 with the application of forces exerted in that direction. Cement fills an annular space above the seat 5 to further secure the seat 5 in the casing 2. A back-flow flapper 6 is pivotally connected to the back-flow flapper seat 5 at a hinge point 7 between the back-flow flapper 6 and the back-flow flapper seat 5. At the hinge point 7, a hinge spring biases the back-flow flapper 6 to a closed position (see FIG. 2B). A stinger sleeve 8 is positioned within the pipe section 2 and is stung into the back-flow flapper seat 5. The stinger sleeve has a stinger section 9, a valve section 10, and a seal section 11.

The stinger section 9 and the seal section 11 are similar to those described above with reference to FIGS. 1A through 1C. The valve section 10 of the stinger sleeve 8 has a float collar 23. The float collar 23 is equipped with a poppet valve 24 that is biased to a closed position by a coil spring 25. A poppet valve mount 26 is held by cement 27 within the stinger sleeve 8. The poppet valve 24 and the poppet valve mount 26 may be constructed of a phenolic plastic or other suitable material. The coil spring 25 may be constructed of a drillable metal or composite material or other suitable resilient or elastomeric material. In the closed position, the poppet valve 24 mates with a poppet seat 28. The coil spring 25 pulls the poppet valve 24 down (forward) through the poppet valve mount 26 so as so bias the poppet valve 24 towards the closed position. Further, a series of one-way pressure equalizer valves, similar to those illustrated in FIGS. 1A through 1C may be positioned in the side walls of the valve section 10 between the stinger section 9 and the poppet valve seat 28. The equalizer valves 40 may be positioned in the tubular cross section of the stinger section 9 immediately below the back-flow flapper seat 5 where the stinger section 9 stings into the back-flow flapper seat 5, or in the heavy-walled, tapered portion of the stinger section 9.

Figure 2B:
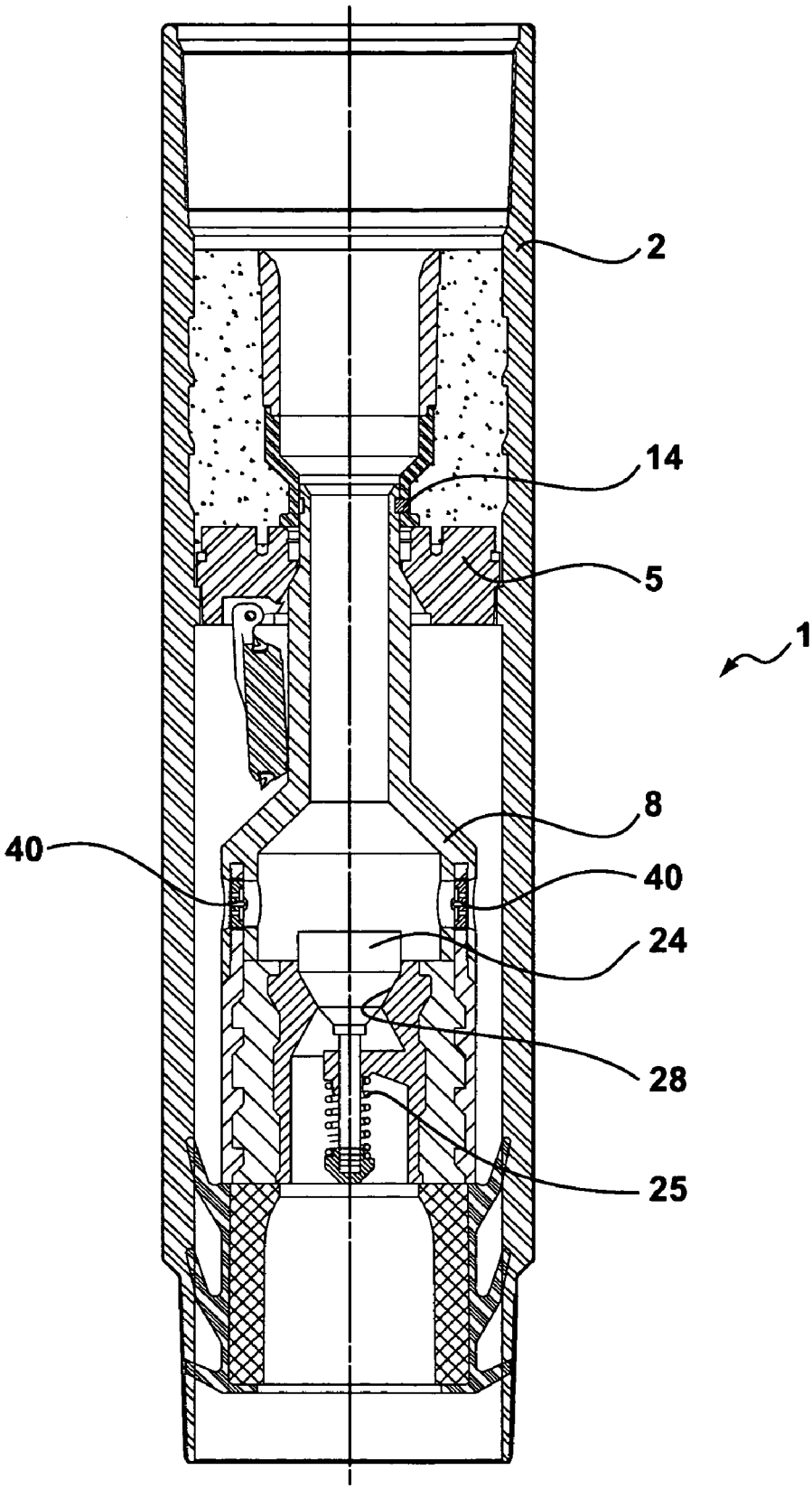
FIG. 2B is a cross-sectional, side view of the reverse cementing float apparatus of FIG. 2A, wherein the poppet valve is closed.
Figure 2C:
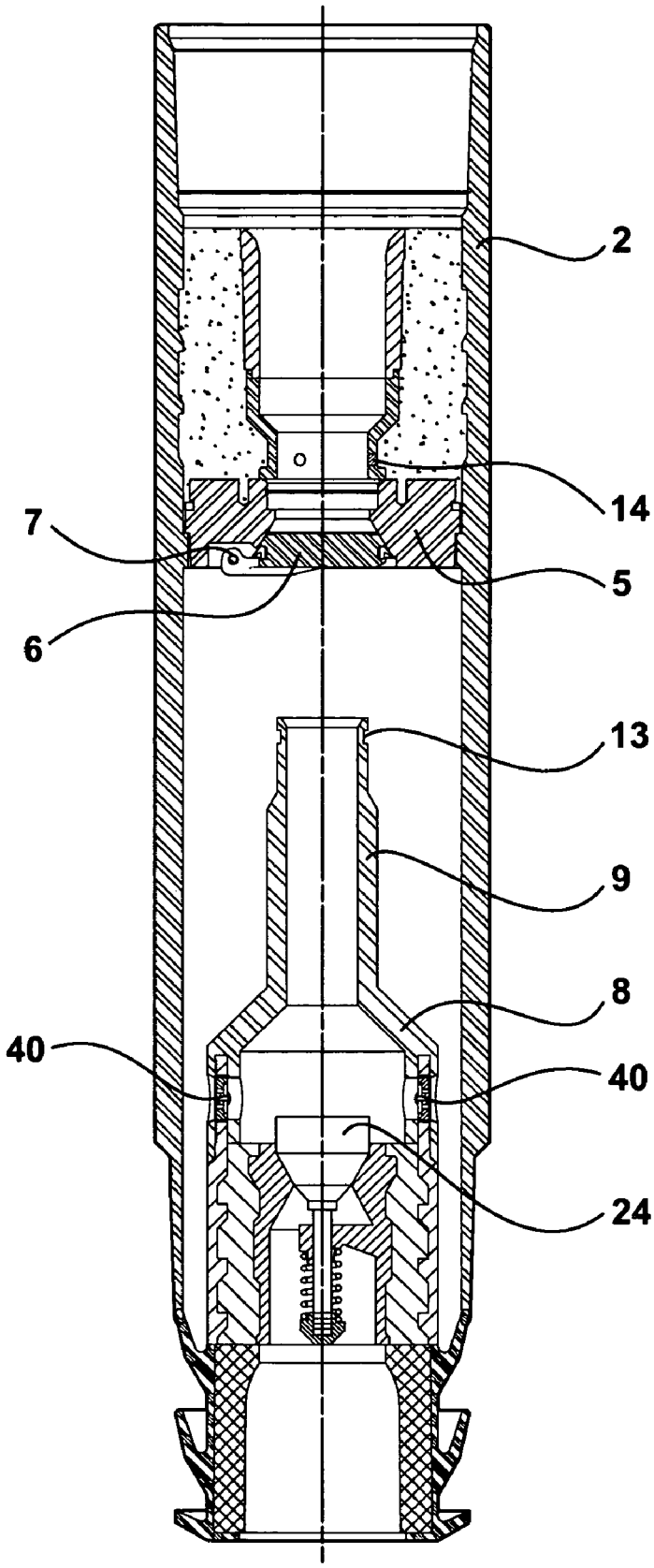
FIG. 2C is a cross-sectional, side view of the reverse cementing float apparatus of FIGS. 2A and 2B, wherein the back-flow flapper is closed.

The operation of the float apparatus illustrated in FIG. 2A is described with reference to FIGS. 2A through 2C. FIGS. 2B and 2C are cross-sectional side views of the float apparatus illustrated in FIG. 2A, wherein the poppet valve 24 is closed in FIG. 2B, and the back-flow flapper 6 is closed in FIG. 2C. The float apparatus 1 is run into a wellbore on a casing string in the configuration illustrated in FIG. 2A. In particular, the stinger sleeve 8 is stung into the hole 12 in the back-flow flapper seat 5 so as to lock the back-flow flapper 6 in an open position. The stinger sleeve 8 is retained in the back-flow flapper seat 5 by a shear pin 14 or a plurality of shear pins or other suitable frangible device(s). As the float apparatus 1 is inserted into the well, static hydraulic fluid pressure in the wellbore increases relative to the static fluid pressure within the pipe section 2. This pressure differential induces a force on the poppet valve 24 and eventually overcomes the biased force of the coil spring 25. When the biased force is overcome, the poppet valve 24 becomes disengaged from the poppet valve seat 28 so as to allow fluid to flow from the wellbore into the pipe section 2 through the valve section 10 of the stinger sleeve 8. This configuration is illustrated on FIG. 2A.

After the float apparatus 1 has been run into the wellbore to its target depth and the cement composition has been reverse circulated into the annulus, the inner diameter of the casing is pressurized to stop or reverse fluid flow through the poppet valve seat 28. The bias force of the coil spring 25 drives the poppet valve 24 downwardly so as to rest firmly in the poppet valve seat 28. This configuration is illustrated in FIG. 2B. With the poppet valve 26 closed, the fluid pressure within the casing string is further increased to induce a force on the top of the poppet valve 26. As the internal pressure continues to increase, it eventually becomes great enough to overcome the restraining force of the shear pin 14. When the shear pin 14 structurally fails, the stinger sleeve 8 is released from the back-flow flapper seat 5. The stinger sleeve 8 is then pumped downwardly in the pipe section 2 as illustrated in FIG. 2C. When the stinger section 9 of the stinger sleeve 8 clears the back-flow flapper 6, the spring at the hinge point 7 rotates the back-flow flapper 6 about the hinge point 7 to a closed position resting in the back-flow flapper seat 5. With the back-flow flapper 6 in the closed position, the internal pressure in the casing string may be released, wherein the closed back-flow flapper 6 prevents fluid in the wellbore annulus from U-tubing into the casing inner diameter.

Figure 3A:
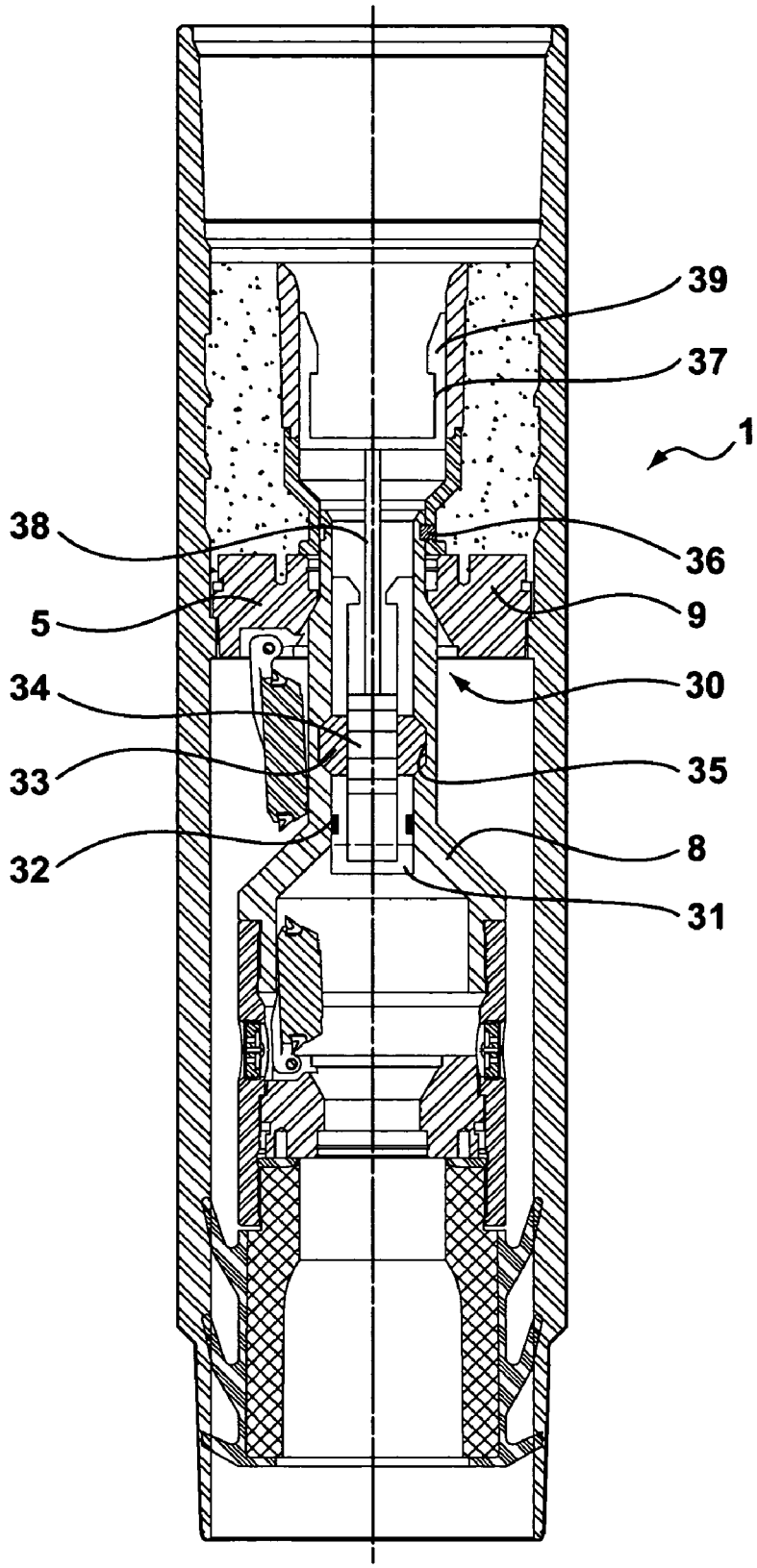
FIG. 3A is a cross-sectional, side view of a reverse cementing float apparatus having back-flow and forward-flow flappers, and also having a float plug locked in a stinger sleeve.

Referring to FIG. 3A, a cross-sectional side view of a float apparatus of the present invention is illustrated. The float apparatus 1 is similar to that described previously with reference to FIG. 1A. However, this apparatus further comprises a float plug 30. The float plug 30 has a float stopper 31 that fits into the neck of the stinger section 9 of the stinger sleeve 8. A stopper seal 32 seals the float stopper 31 to the stinger section 9 to prevent fluid from flowing through the stinger sleeve 8. A plurality of dogs 33 are positioned in slots in the midsection of the float stopper 31. The float stopper 31 has a hollow bore into which a dog lock 34 is inserted. When the float stopper 31 is locked in the stinger sleeve 8, the dog lock 34 is positioned in the middle of the dogs 33 so as to push the dogs 33 radially outward into a retainer groove 35. The retainer groove 35 is in the inner bore of the stinger section 9 of the stinger sleeve 8. At the top of the float stopper 31, hooks 36 extend radially into the center of the float stopper 31.

The float stopper 31 also has a stinger catcher 37 that is positioned in a relatively wider bore above the back-flow flapper seat 5. The stinger catch 37 is connected to the dog lock 34 by a tie rod 38. The stinger catcher 37 also has stinger hooks 39 that extend radially inward toward the middle of the stinger catcher 37 for engagement with a stinger (not shown). In alternative embodiments, the stinger catcher 37 need not be housed in the wider bore above the back-flow flapper seat 5 as illustrated, but rather, it may extend above the top of the concrete and may be an extension of tie rod 38 that is retrievable with any number of OD or ID grapples commonly known to persons of skill in the fishing tool industry. The basic function of the catcher 37 remains the same regardless of the type fishing neck (or catcher) used.

Figure 3B:
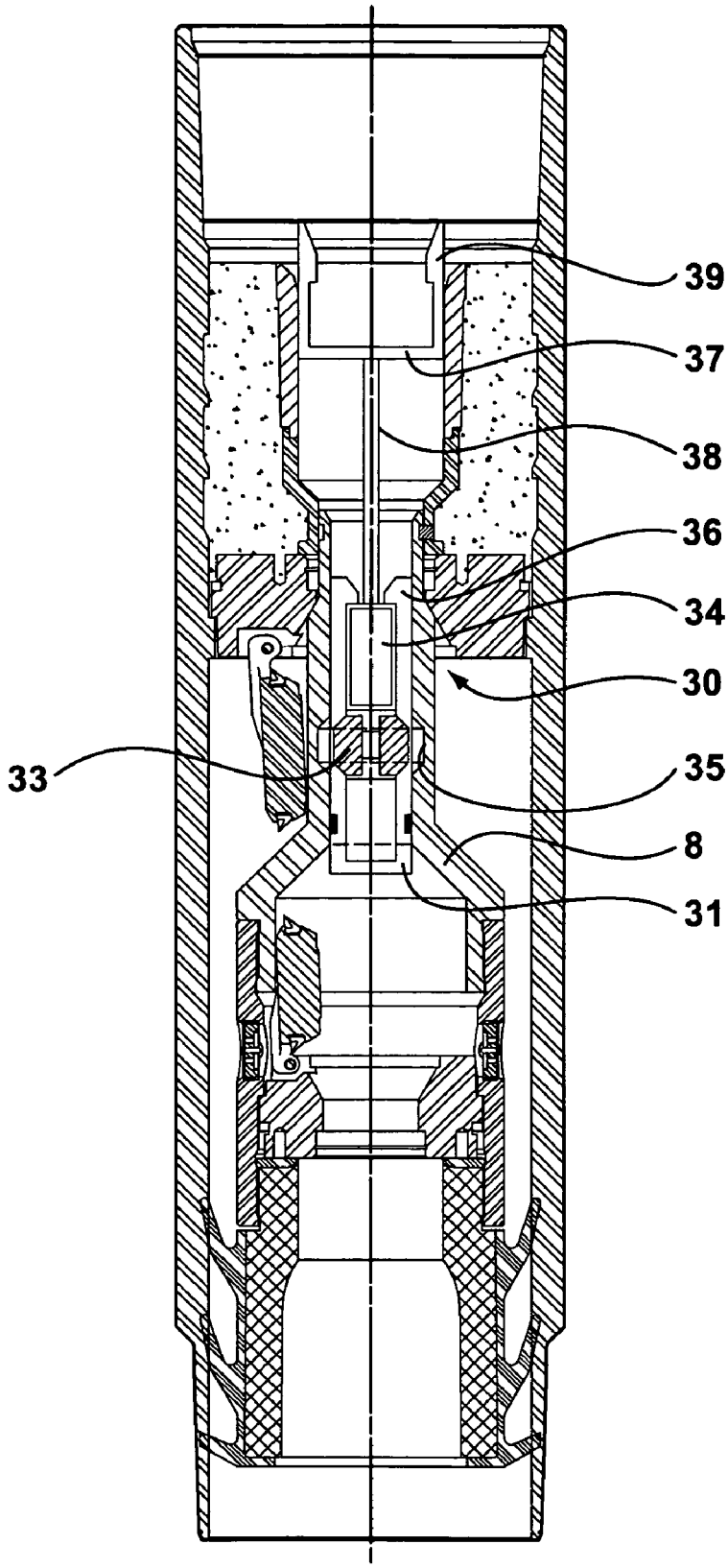
FIG. 3B is a cross-sectional, side view of the reverse cementing float apparatus of FIG. 3A, wherein the float plug is unlocked from the stinger sleeve.

Referring to FIG. 3B, a cross-sectional side view of the float apparatus of FIG. 3A is illustrated. While a stinger is not shown for simplicity, FIG. 3B illustrates a configuration of the float plug 30 after a stinger has been inserted into the stinger catcher 37 and the dogs 33 have been unlocked. To unlock the dogs 33, the stinger catcher 37 is pulled upwardly in the apparatus to draw the dog lock 34 upwardly within the float stopper 31 via the tie rod 38. When the dog lock 34 is no longer positioned behind the dogs 33, the dogs 33 are free to move radially inward toward the middle of the float stopper 31. As the dogs 33 move radially inward, they disengage from the retainer groove 35. This disengagement unlocks the float stopper 31 from the stinger sleeve 8 so that the float stopper 31 is free to be withdrawn therefrom. As the dog lock 34 is pulled from behind the dogs 33, it engages hooks 36 at the top of the float stopper 31. When the stinger catcher pulls the dog lock 34 upwardly by the tie rod 38, the dog lock 34 engages the hooks 36 to drag the float stopper 31 out of the stinger sleeve 8.

Figure 3C:
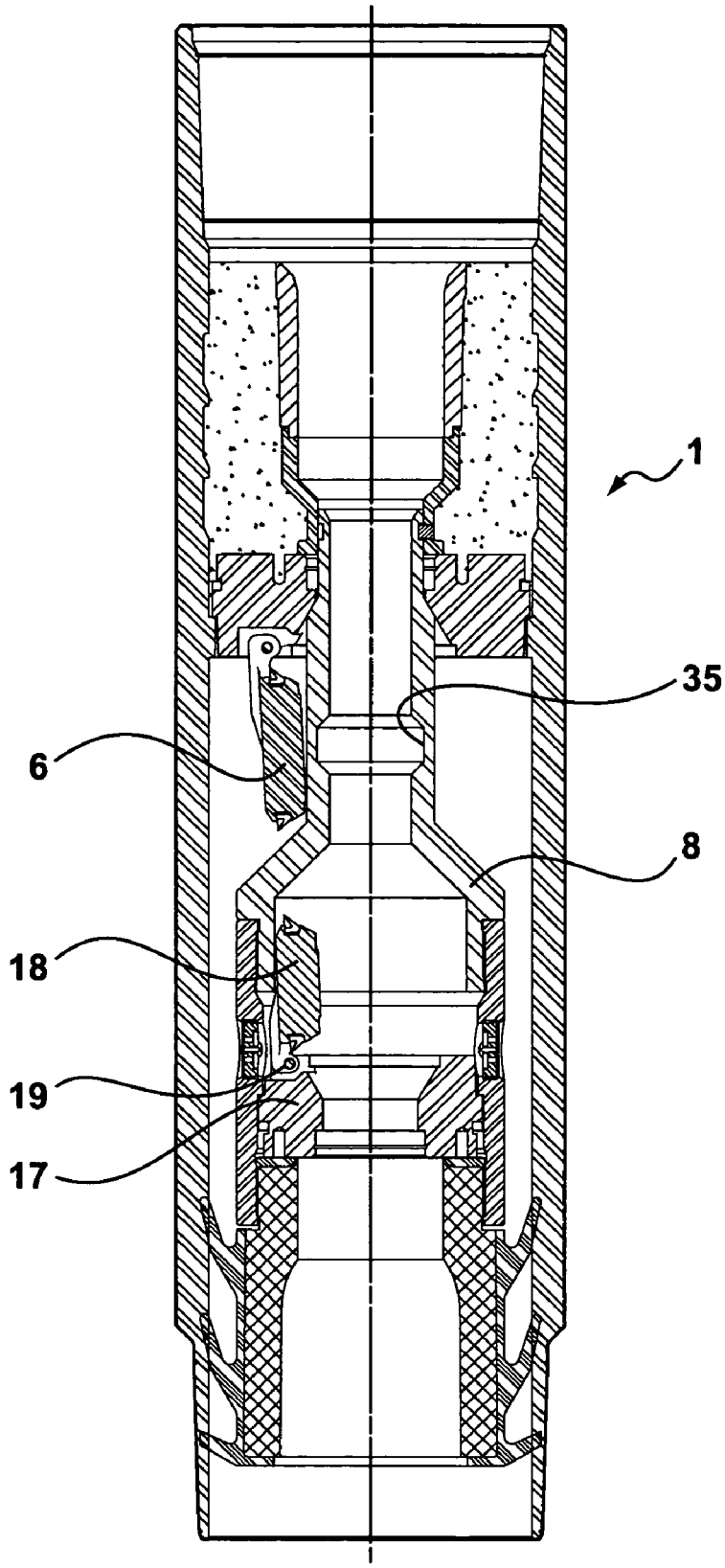
FIG. 3C is a cross-sectional, side view of the reverse cementing float apparatus of FIGS. 3A and 3B, wherein the float plug is removed from the stinger sleeve.

FIG. 3C illustrates a cross-sectional side view of the float apparatus of FIGS. 3A and 3B. In this illustration, the float stopper 31 is completely withdrawn from the float apparatus 1, so as to allow fluid to freely flow up through the float apparatus 1. In particular, the fluid flows up through the forward-flow flapper seat 17 by working against the biasing spring of the forward-flow flapper 18. The back-flow flapper 6 is held in the open position by the stinger sleeve 8.

The float stopper 31 illustrated in FIGS. 3A through 3C, may be used to close the float apparatus 1, as the apparatus is run into the wellbore. Because the float stopper 31 prevents fluid from flowing into the casing from the wellbore, the casing may become buoyant in the wellbore so that not all of the weight of the casing is born by the derrick surface equipment. When the casing reaches the target depth, a stinger may be run into the inner diameter of the casing on a wire line, coil tubing or any other mechanism known to persons of skill so as to engage the stinger catcher 37. Once the casing and float apparatus 1 are positioned in the wellbore at the target depth, the stinger catcher 37 may be used to pull the float stopper 31 from the float apparatus to allow fluid to flow into the casing inner diameter. With the float apparatus now open, reverse circulation cementing operations may be conducted in the wellbore. A cement composition slurry is pumped down the annulus while returns are taken up through the float apparatus 1 until the cement composition reaches the float apparatus or any other desired depth. When a desired amount of cement composition has been pumped into the annulus, the inner diameter of the casing is pressurized such that the fluid in the wellbore begins to flow in a conventional direction. The bias spring at hinge point 19 then rotates the forward-flow flapper 18 to a closed position in the forward-flow flapper seat 17. As previously described, the stinger sleeve 8 is then pumped downwardly relatively to the back-flow flapper seat 5 so as to release the back-flow flapper 6. When the back-flow flapper 6 becomes closed, the pressure within the inner diameter of the casing may be released and the cement composition is held in the annulus by the back-flow flapper 6.

While the float plug 30 is described with reference to a dual-flapper embodiment of the invention as illustrated in FIGS. 3A through 3C, in other embodiments of the invention, the float plug may be employed in float apparatuses such as that illustrated in FIGS. 2A through 2C.

In alternative embodiments, a float plug may be a one-way valve that allows fluid to escape the inner diameter of the casing through the float plug, but prevents fluid from flowing from the annulus into the casing inner diameter. In these embodiments, the float plug may be pumped out of the bottom of the float apparatus 1 by dropping a ball on the float plug and pressuring the inner diameter of the casing string. Also, a service string may be inserted down the casing inner diameter to push the float plug out of the float apparatus. Float plugs suitable for use with this invention are illustrated in U.S. Pat. No. 6,244,342, the disclosure of which is incorporated herein by reference in its entirety.

The inventive float apparatuses disclosed herein may be useful in reverse circulation cementing operations. These float apparatuses may be run into wellbores at the lower end of a casing string to be cemented into the wellbore. Once the casing and float apparatus have reached the target depth, a cement composition may be pumped down the annulus between the casing and the wellbore while returns are taken up through the float apparatus and the inner diameter of the casing. As these returns reverse circulate up through the float apparatus, the valve sections of the stinger sleeves remain open so as to allow the returns to flow through the float apparatus. When the cement composition reaches the bottom of the annulus at the float apparatus, reverse circulation is stopped and fluid pressure on the inner diameter of the casing is increased. The pressure increase on the inner diameter of the casing acts on the closed valve section of the float apparatus as previously described. Further increased pressure on the inner diameter of the casing pumps the stinger sleeve out of the back-flow flapper seat so as to allow the back-flow flapper to close. The fluid pressure in the inner diameter of the casing string may then be released, and the back-flow flapper seals the float apparatus to hold the cement composition in the annulus. U-tubing up through the float apparatus into the casing inner diameter is thereby prevented.

Therefore, the present invention is well adapted to carry out the objects and attain the ends and advantages mentioned as well as those that are inherent therein. While the invention has been depicted and described with reference to embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A regulating valve assembly for regulating fluid flow through a passage, the assembly comprising:

a back-flow valve comprising a seat and a closure element, wherein the closure element engages with the seat in a closed configuration and disengages from the seat in an open configuration;

a lock in mechanical communication with the back-flow valve to lock the back-flow valve in the open configuration;

a forward-flow valve in mechanical communication with the lock and comprising a seat and a closure element, wherein the closure element engages with the seat in a closed configuration and disengages from the seat in an open configuration;

wherein the back-flow valve and the forward-flow valve operate independently; and wherein the lock disengages in response to forward fluid flow.

2. A regulating valve assembly as claimed in claim 1, wherein the closure element of the back-flow valve is a flapper biased to the closed configuration.

3. A regulating valve assembly as claimed in claim 1, wherein the lock comprises a sleeve.

4. A regulating valve assembly as claimed in claim 1, wherein the lock comprises a sleeve, wherein the sleeve locks the back-flow valve in the open configuration when the sleeve is stung in the seat of the back-flow valve and unlocks the back-flow valve when the sleeve is unstung from the seat of the back-flow valve.

5. A regulating valve assembly as claimed in claim 1, wherein the closure element of the forward-flow valve is a flapper biased to the closed configuration.

6. A regulating valve assembly for regulating fluid flow through a passage, the assembly comprising:

a back-flow valve comprising a seat and a closure element, wherein the closure element engages with the seat in a closed configuration and disengages from the seat in an open configuration;

a sleeve, wherein the sleeve stings into the seat of the back-flow valve when the back-flow valve is in the open configuration and unstings from the seat of the back-flow valve when the back-flow valve is in the closed configuration;

a forward-flow valve positioned with the sleeve and comprising a seat and a closure element, wherein the closure element engages with the seat in a closed configuration and disengages from the seat in an open configuration;

wherein the back-flow valve and the forward-flow valve operate independently; and wherein the sleeve unstings in response to forward fluid flow.

7. A regulating valve assembly as claimed in claim 6, wherein the closure element of the back-flow valve is a flapper biased to the closed configuration.

8. A regulating valve assembly as claimed in claim 6, wherein the closure element of the forward-flow valve is a flapper biased to the closed configuration.

9. A method for reverse-cementing casing in a wellbore, the method comprising:

locking a back-flow valve in an open configuration and making the back-flow valve up to the casing;

making a forward-flow valve up to the casing, wherein the forward-flow valve allows fluid to flow into the casing inner diameter and restricts fluid flow out of the casing inner diameter.

running the casing equipped with the back-flow valve and the forward-flow valve into the wellbore to a target depth;

reverse-circulating a cement composition into an annulus defined in the wellbore by the casing;

taking fluid returns through the back-flow valve as the cement composition is reverse-circulated into the annulus;

unlocking the back-flow valve; and closing the back-flow valve, whereby the cement composition is retained in the annulus by the back-flow valve.

10. A method for reverse-cementing casing in a wellbore as claimed in claim 9, wherein the locking a valve in an open position comprises stinging a sleeve into a flapper seat of the back-flow valve, and wherein the closing the back-flow valve comprises unstinging a sleeve from the flapper seat of the back-flow valve.

11. A method for reverse-cementing casing in a wellbore as claimed in claim 9, wherein the taking fluid returns through the back-flow valve as the cement composition is reverse-circulated into the annulus comprises flowing the returns through the forward-flow valve.

12. A method for reverse-cementing casing in a wellbore as claimed in claim 9, wherein the unlocking the back-flow valve comprises closing the forward-flow valve to restrict fluid flow from the inner diameter of the casing to the annulus and increasing the fluid pressure in the inner diameter of the casing.

13. A method for reverse-cementing casing in a wellbore as claimed in claim 9, further comprising restricting fluid flow from the annulus into the inner diameter of the casing so as to float the casing as the casing is run into the wellbore.

14. A method for reverse-cementing casing in a wellbore as claimed in claim 9, further comprising choking fluid flow from the wellbore into the inner diameter of the casing, wherein fluid flow in the reverse-circulation direction is slowed.

* * * * *